US011331902B2

(12) United States Patent
Qi et al.

(10) Patent No.: US 11,331,902 B2
(45) Date of Patent: May 17, 2022

(54) BLOWING MEANS UNIT AND HOT FOIL STAMPING AND DIE-CUTTING DEVICE

(71) Applicant: Bobst (Shanghai) Ltd, Shanghai (CN)

(72) Inventors: Peicong Qi, Shanghai (CN); Haoming Song, Shanghai (CN)

(73) Assignee: Bobst (Shanghai) Ltd, Shanghai (CN)

( * ) Notice: Subject to any disclaimer, the term of this patent is extended or adjusted under 35 U.S.C. 154(b) by 0 days.

(21) Appl. No.: 16/978,635

(22) PCT Filed: Mar. 4, 2019

(86) PCT No.: PCT/IB2019/051714
§ 371 (c)(1),
(2) Date: Sep. 4, 2020

(87) PCT Pub. No.: WO2019/171240
PCT Pub. Date: Sep. 12, 2019

(65) Prior Publication Data

US 2020/0406606 A1 Dec. 31, 2020

(30) Foreign Application Priority Data

Mar. 5, 2018 (CN) ..... 201810179095.6

(51) Int. Cl.
*B41F 16/00* (2006.01)
*B26F 1/38* (2006.01)
*B41F 19/06* (2006.01)

(52) U.S. Cl.
CPC ..... *B41F 16/0093* (2013.01); *B26F 1/38* (2013.01); *B41F 16/0046* (2013.01); *B41F 19/068* (2013.01)

(58) Field of Classification Search
CPC ..... B41F 16/0093
(Continued)

(56) References Cited

U.S. PATENT DOCUMENTS 4,059,470 A 11/1977 Primavesi et al.
5,840,155 A * 11/1998 Rebeaud ..... B41F 19/068 156/757
8,881,649 B2 * 11/2014 De Gaillande ..... B41F 1/44 101/27

(Continued)

FOREIGN PATENT DOCUMENTS

CN 2858284 Y 1/2007
CN 2923315 Y 7/2007

(Continued)

OTHER PUBLICATIONS

International Search Report dated Jun. 27, 2019, in counterpart International Patent Application No. PCT/IB2019/051714 (2 pages, in English).

(Continued)

*Primary Examiner* — Matthew G Marini
*Assistant Examiner* — Marissa Ferguson-Samreth
(74) *Attorney, Agent, or Firm* — Bookoff McAndrews, PLLC

(57) ABSTRACT

The present invention relates to a blowing means unit and a hot foil stamping and die-cutting device. The blowing means unit fora hot foil stamping device, comprising: a blowing means having a blowing part configured to inject a gas stream to a location of foil material to separate foil and a supporting part for supporting the blowing part; supporting means supporting the blowing means; and lifting means connected to the supporting means for moving the blowing means between a first position and a second position, in the first position, the blowing part of the blowing means is at a working level, and in the second position, the blowing means is at a non-working level to give access to an operation area.

9 Claims, 4 Drawing Sheets

(58) Field of Classification Search
USPC ..... 101/27
See application file for complete search history.

(56) References Cited

U.S. PATENT DOCUMENTS

| | | | | |
|---|---|---|---|---|
| 2004/0206254 | A1* | 10/2004 | Both | B41F 16/00 101/27 |
| 2005/0247406 | A1* | 11/2005 | Kagi | B41F 19/068 156/494 |
| 2009/0178581 | A1* | 7/2009 | Paita | B41J 17/28 101/27 |
| 2009/0211468 | A1* | 8/2009 | Steuer | B41F 19/064 101/23 |
| 2010/0294145 | A1* | 11/2010 | Song | B41F 13/52 101/27 |
| 2013/0160663 | A1 | 6/2013 | De Gaillande | |
| 2013/0161367 | A1* | 6/2013 | Girard | B65H 20/00 226/1 |
| 2015/0266288 | A1* | 9/2015 | Bieber | B41F 16/002 101/27 |
| 2018/0229543 | A1* | 8/2018 | Banziger | H05B 6/14 |

FOREIGN PATENT DOCUMENTS

| | | | |
|---|---|---|---|
| CN | 200963925 | Y | 10/2007 |
| CN | 201456541 | U | 5/2010 |
| CN | 201544533 | U | 8/2010 |
| CN | 104129182 | A | 11/2014 |
| CN | 104773543 | A | 7/2015 |
| CN | 207030516 | U | 2/2018 |
| GB | 2475981 | A | 6/2011 |
| JP | S51-55085 | A | 5/1976 |
| JP | S61-35796 | U | 3/1986 |
| JP | H08-034112 | A | 2/1996 |
| JP | H10-203095 | A | 8/1998 |
| JP | 2004-314175 | A | 11/2004 |
| JP | 2006-168933 | A | 6/2006 |
| JP | 2012-218784 | A | 11/2012 |
| JP | 2013-538768 | A | 10/2013 |
| JP | 2013-542866 | A | 11/2013 |
| KR | 10-2013-0064112 | A | 6/2013 |
| WO | 2017186772 | A1 | 11/2017 |
| WO | 2018028980 | A1 | 2/2018 |

OTHER PUBLICATIONS

Taiwanese Office Action dated Oct. 3, 2019 in counterpart Taiwanese Patent Application No. 108104774 (18 pages, in Chinese with English translation).

Korean Office Action issued in corresponding Korean Patent Application No. 10-2020-7028086 dated Jul. 20, 2021, with English translation (12 pages).

* cited by examiner

BLOWING MEANS UNIT AND HOT FOIL STAMPING AND DIE-CUTTING DEVICE

CROSS-REFERENCE TO RELATED APPLICATION(S)

This application is a National Stage under 35 U.S.C. § 371 of International Application No. PCT/IB2019/051714, filed on Mar. 4, 2019, which claims priority to Chinese Patent Application No. 201810179095.6, filed on Mar. 5, 2018, the contents of all of which are incorporated by reference in their entirety.

FIELD OF THE INVENTION

The present invention relates to the field of packaging, and particularly relates to hot foil stamping and die-cutting device for mode transition.

BACKGROUND OF THE INVENTION

A hot foil stamping technology is a technology for pressing a metallic foil or hologram on thin paper, card paper, a composite material, plastic and a corrugated board via heating and pressing. Flat-pressing flat-die-cutting is a process suitable for carrying out die cutting, indentation, embossing, stripping and full stripping on various types of paper, such as thin paper, card paper, corrugated paper, plastic, an in-mold label, a micro corrugated paperboard and most of corrugated paperboards. Operation of a hot foil stamping die cutting machine is similar with that of a flat-pressing flat-die-cutting machine in principle, and functions of some device can be interchanged. When a hot foil stamping mode is subjected to transition into a die-cutting mode, generally, an advance shaft for enabling a metal foil to move in the original hot foil stamping mode shall be removed, and the blowing means for separating a foil material shall be also removed, then an upper cutting die board as well as a stripping assembly are mounted. Therefore, the mode transition of hot foil stamping die-cutting device is a time-consuming and laborious work.

Therefore, existing hot foil stamping die-cutting device needs to be modified so as to improve convenience of mode transition.

SUMMARY OF INVENTION

In order to improve the convenience of mode transition, the prevent invention provides a blowing means unit for a hot foil stamping device, comprising: a blowing means having a blowing part configured to inject a gas stream to a location of foil material to separate foil and a supporting part for supporting the blowing part; supporting means supporting the blowing means; and lifting means connected to the supporting means for moving the blowing means between a first position and a second position, in the first position, the blowing part of the blowing means is at a working level, and in the second position, the blowing means is at a non-working level to give access to an operation area.

According to an aspect of the invention, the blowing means unit further comprises displacement means provided between the blowing means and the supporting means for displacing the blowing means with respect to the supporting means between a projection position and a retracting position.

According to another aspect of the invention, the lifting means is configured to lift and lower the blowing means when the blowing means is disposed in the retracting position.

According to another aspect of the invention, the displacement means includes a first slider and a second slider that are slidably mated with each other, one of the first slider and the second slider is provided to the supporting means, and the other of the first slider and the second slider is provided to the supporting part of the blowing means.

Preferably, the displacement means further includes a displacement actuator, which comprises one of pneumatic means, hydraulic means and a motor.

According to another aspect of the invention, the blowing means unit further comprises a position sensor for detecting a position of the blowing means member of the blowing means.

According to a further aspect of the invention, the lifting means includes driving means and/or transmission means. Preferably, the driving means comprise one or more of a motor, a belt, a chain, a cable, hydraulics and pneumatics, and the transmission means comprises a belt, chain, gear, pulley and/or rod.

According to another aspect of the present invention, the driving means comprise a motor, the transmission means comprise a lifting member, the lifting member being connected to the supporting means and the motor enabling the lifting member to extend and retract.

According to another aspect of the present invention, the transmission means further include a plurality of pulleys, and the lifting member is arranged around the pulleys.

According to another aspect of the present invention, the transmission means further include a transmission rod driven by the driving means, the transmission rod extending substantially parallel to the at least one advance shaft, one end of the lifting member being engaged with the transmission rod and the other end of the lifting member being engaged with the supporting means.

According to another aspect of the present invention, the supporting means includes a first bracket for supporting a first end of the at least one advance shaft and a second bracket for supporting a second end of the at least one advance shaft; and the transmission means include first lifting member connecting to the first bracket and second lifting member connected to the second bracket, the first lifting member is respectively connected to a first end of the transmission rod and the first bracket, and the second lifting member is respectively connected to a second end of the transmission rod and the second bracket.

According to another aspect of the present invention, wherein the lifting means further includes an accommodating guide for accommodating an end portion of the lifting member, and the accommodating guide is arranged in a plane perpendicular to the transmission rod.

According to another aspect of the present invention, the motor is mounted outside of the end of the advance shaft.

Further, the present invention also provides a hot foil stamping device having a hot foil stamping working mode and a die-cutting working mode, wherein the hot foil stamping device is provided with the blowing means unit as above described, when the hot foil stamping die-cutting device is in the hot foil stamping working mode, the blowing means is disposed in the first position, and when the hot foil stamping die-cutting device is in the die-cutting working mode, the blowing means is disposed in the second position.

According to one aspect of the invention, the supporting means further support at least one advance shaft for feeding foils to a stamping area, in the first position, the at least one advance shaft is in an operation position, and in the second position, the at least one advance shaft is in a non-operation position.

According to another aspect of the invention, the hot foil stamping device comprises: a feeding station for feeding sheets to the hot foil stamping die-cutting device; a platen station, the platen station being positioned on the downstream of the feeding station along a sheet conveying direction and used for carrying out pressing-cutting or embossing machining on the sheets; a foil-feeding and stripping station positioned on the downstream of the platen station along a sheet conveying path; and a delivery station positioned on the downstream of the foil-feeding and stripping station and used for enabling the machined sheets to form a sheet stack, wherein the blowing means unit is arranged in the foil-feeding and stripping station, and when the hot foil stamping die-cutting device is in a die-cutting mode, the blowing means is moved to the second position, and a stripping apparatus is arranged below the blowing means.

By adopting the advance shaft transition apparatus according to the present invention, convenience in transition of the hot foil stamping and die-cutting device between the bronzing and die-cutting modes is obviously improved.

REFERENCE NUMBER LIST

Figure 1:
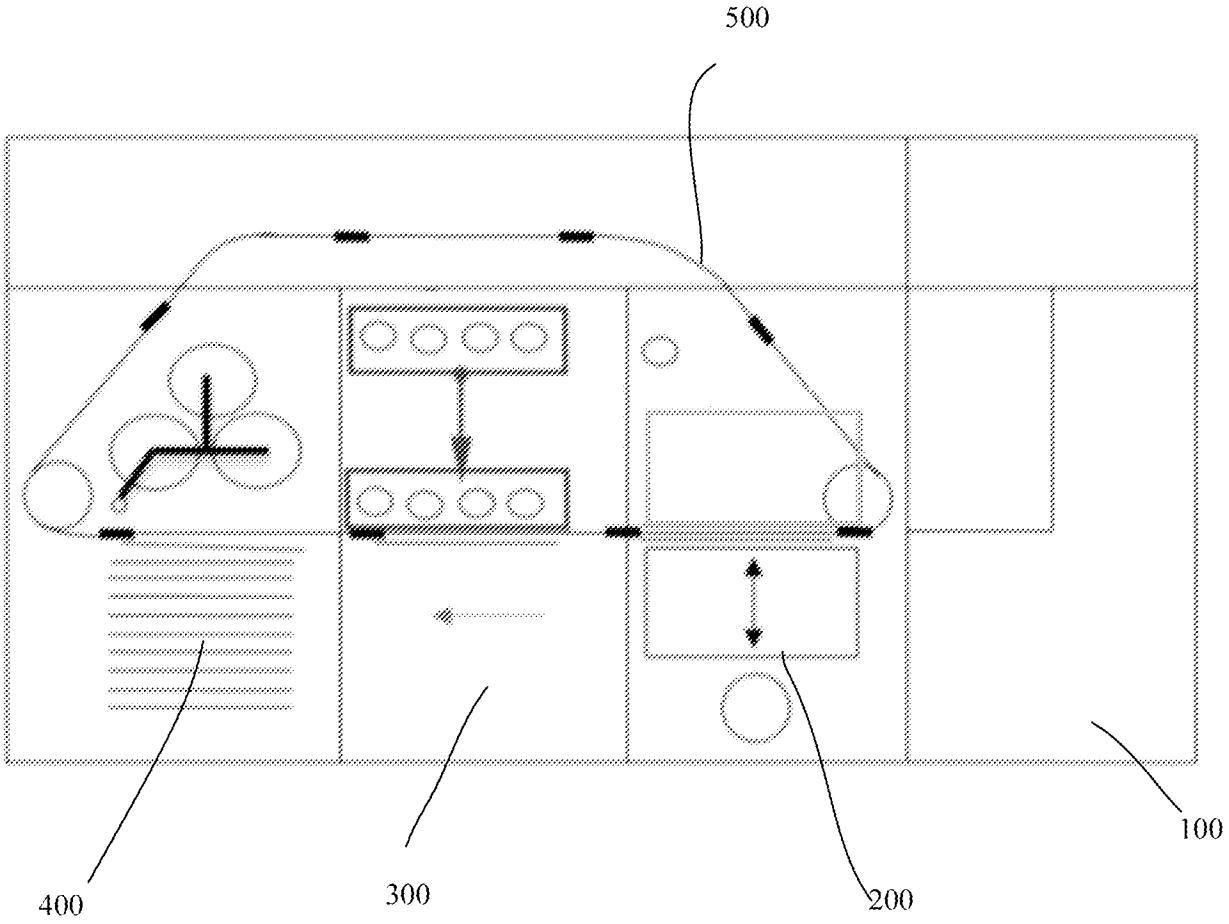
FIG. 1 shows a schematic diagram of hot foil stamping and die-cutting device according to the present invention.

10 hot foil stamping die-cutting device
100 feeding station
200 platen station
300 foil-feeding and stripping station
400 delivery station
500 conveying apparatus
21 advance shaft
22 supporting means
24 lift member
25 transmission rod
26 pulley
27 accommodating guide
29 transmission chain
30 blowing means
31 blowing part
32 supporting member
33 displacement means
35 cylinder means

DESCRIPTION OF THE EMBODIMENTS

Hereinafter, the present invention will be described further in conjunction with particular embodiments and accompanying drawings. More details are illustrated in the following description for sufficient understanding of the present invention, however, the present invention can be implemented in many other manners different from what is described here obviously. A person skilled in the art can make similar promotions and deductions without departing from the essence of the present invention as required and thus the protection scope of the present invention shall not be limited by the disclosure of these particular embodiments.

FIG. 1 shows a schematic diagram of hot foil stamping and die-cutting device 10 used in the field of paperboard packaging. The hot foil stamping and die-cutting device 10 consists of a plurality of stations and has a hot foil stamping working mode and a die-cutting working mode. Generally, along a direction of a main conveying path of sheets in the hot foil stamping and die-cutting device 10, the hot foil stamping and die-cutting device 10 sequentially includes: a feeding station 100 for feeding sheets, such as paperboards, to the hot foil stamping and die-cutting device 10; a platen station 200, a plating machine being arranged at the station 200 so as to carry out forming machining of pressing-cutting, embossing, stamping and the like; a foil-feeding and stripping station 300 for conveying of a hot-ironed foil material or stripping processing after die-cutting; and a delivery station 400 enabling finished sheets to reform a stack so as to facilitate subsequent steps. Moreover, a conveying apparatus 500, which includes such as conveying chain and locking means for clamping sheets provided on the chain, for conveying the sheets between each station is also arranged in the device 10.

For conversion of the hot foil stamping working mode and the die-cutting working mode of the hot foil stamping and die-cutting device 10, arrangement structures in the foil-feeding and stripping station 300 need to be subjected to transition.

When the hot foil stamping and die-cutting device 10 is adopted to carry out bronzing processing, there are at least one advance shaft 21 and a blowing means unit arranged in the station 300. A foil material is fed into the platen station 200 by the advance shaft, and a sheet to be processed is fed into the platen station 200 from the feeding station, both of the foil material and the sheet pass through a space between a top platen and a bottom platen to perform a hot-stamping process. During the hot-stamping process, the blowing means at the station 300 injects air flow to separate the foil material, that is, separate a foil from its back membrane.

When the hot foil stamping and die-cutting device 10 is adopted to carry out die-cutting machining, the advance shafts 21 and the blowing means 30 in the station 300 is moved to a position close to a top device frame of the device, a stripping apparatus is mounted in the station 300, and meanwhile, the platens of the platen station 200 are replaced with machining tools for die-cutting, so that the sheet fed to the station 200 from the feeding station 100 is subjected to die-cutting machining in the platen station 200, then the sheet subjected to die-cutting machining is conveyed to the stripping station 300 by the conveying apparatus 500, and in the stripping station 300, the device 10 carries out stripping process on the sheet.

According to the present invention, the hot foil stamping and die-cutting device 10 is particularly provided with a blowing means unit and an advance shaft transition apparatus on the foil-feeding and stripping station 300, which is used for carrying out transfer transition of an arrangement position of the blowing means and the advance shaft 21 in the device machining mode switching process.

According to a preferable embodiment of the present invention, the blowing means unit comprises a blowing part 31 and a supporting part 32 supporting the blowing part. The blowing part 31 is configured to inject air flow to the position where the foil material is disposed so as to separate a foil from this back membrane, and generally, a blowing part 31 includes a plurality of injection tubes connecting to an air source, and these injection tubes are provided on the supporting part at intervals. Two ends of the supporting part are attached to a supporting means 22, which preferably includes two brackets. The supporting means 22 is in turn attached to a lifting means for moving the blowing means between a first position and a second position. In the first position, the blowing part 31 of the blowing means is at a working level and aligns with a separating portion of the foil material; and in the second position, the blowing means is at a non-working level to give access to an operation area for allowing the sheet to be fed into for a next processing step. In general, the second position is a position where the blowing means is close to the top frame of the device.

In order to avoid the blowing means 30 from impacting other parts of the hot foil stamping die-cutting device 10 during its movement and also in order to save a mounting space for the mode transition apparatus, preferably, the blowing means unit further comprises displacement means for displacing the blowing means with respect to the supporting means 22 between a projection position where the blowing means projects from an end of the supporting means 22 and a retracting position where the blowing means retracts into the end of the supporting means 22. The displacement means is provided between the blowing means 30 and the supporting means 22.

Figure 3:
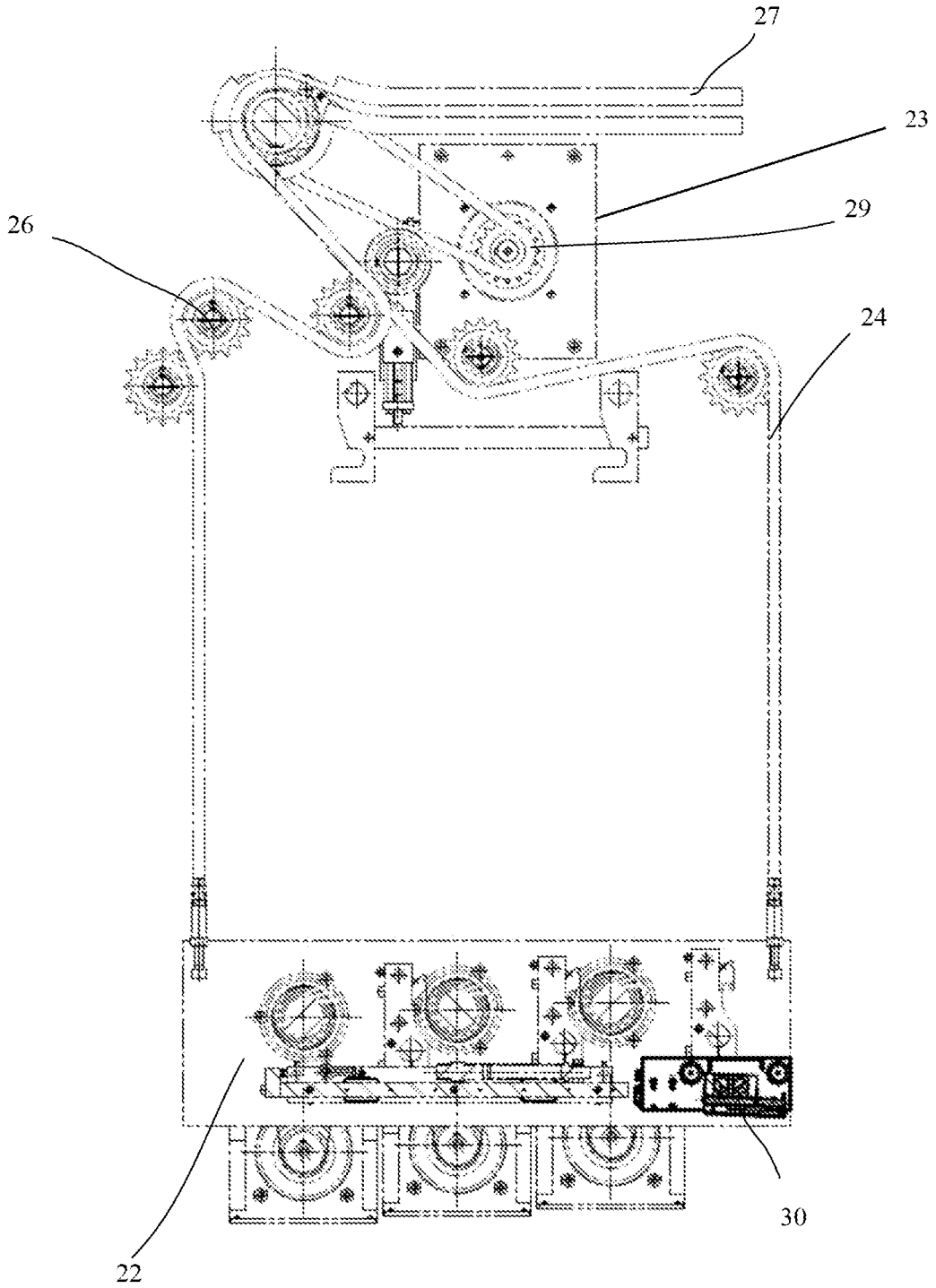
FIG. 3 shows a side view of the hot foil stamping and die-cutting device including the blowing means unit according to the present invention, wherein the blowing means is displaced into a retracting position.

FIG. 3 shows the blowing means 30 in the retracting position. When the blowing means is in the retracting position, it is allowed that the lifting means brings the blowing means to move up and down between the first position and the second position.

Figure 4:
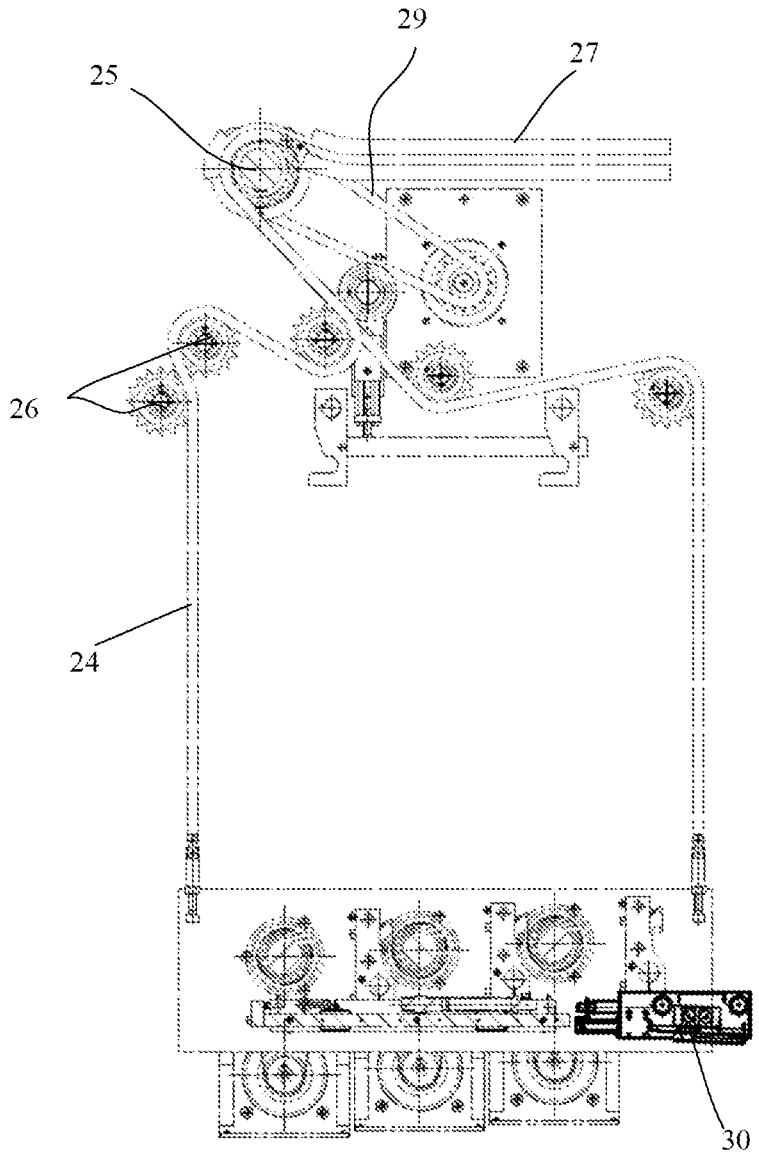
FIG. 4 shows a side view of the hot foil stamping and die-cutting device including the blowing means unit according to the present invention, wherein the blowing means is displaced into a projection position.

FIG. 4 shows blowing means 30 in the projection position. When the blowing means is in the projection position, the blowing means can be actuated for foil-separating operation.

Preferably, the displacement means includes two sliders 41 and 42 that are slidably mated with each other, such as a slide block and a slide rail, one of the sliders 41 is provided to the supporting means, and the other of sliders 42 is provided to the supporting part of the blowing means. In the embodiment, there are two displacement means, which are provided at the two sides of the blowing means, respectively.

Figure 2:
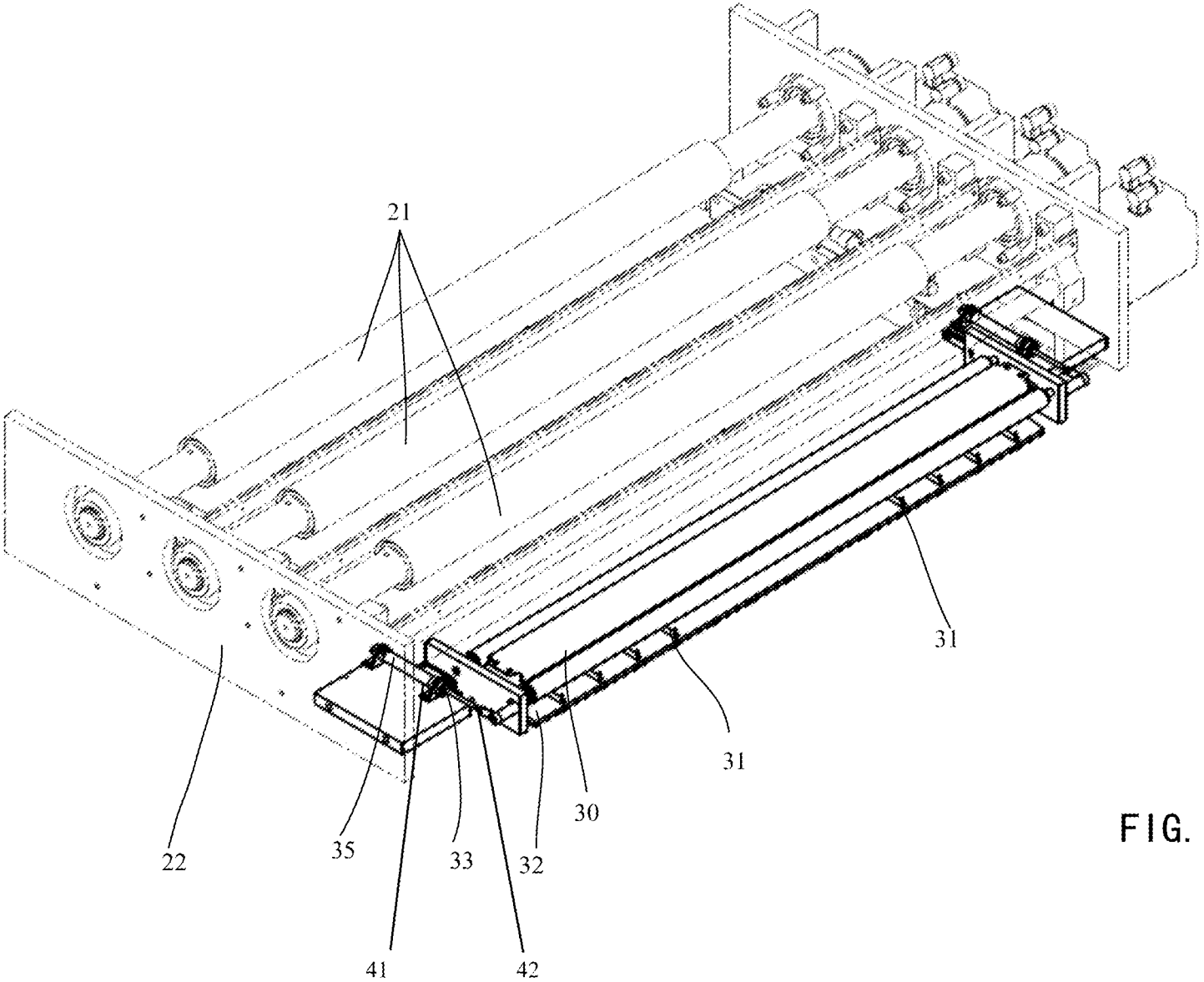
FIG. 2 shows a perspective view of the blowing means the hot foil stamping and die-cutting device according to the present invention.

In the embodiment, the displacement means of the blowing means unit 30 further includes cylinder means 35 used as a displacement actuator. The cylinder means 35 includes a cylinder body and an actuator rod retractable with respect to the cylinder body. As shown in FIG. 2, the cylinder body of the cylinder means 35 is fixed to the supporting means, and one end of the actuator rod is fixed to the supporting part of the blowing means so as for providing displacing force to the blowing means 30.

The displacement means is not limited to the above, other kinds of actuators, such as pneumatic means, hydraulic means and a motor, can be adopted. When the motor is used as the displacement means actuator, the displacement means may have a configuration of pinion and rack.

Further, the blowing means unit further includes a sensor for detecting the position of the blowing means. When the sensor detects that the cylinder means 35 moves the blowing means into the projection position, the sensor transfers a signal to a controller of the hot foil stamping device to allow the blowing means to inject air flow. In the other hand, when the sensor detects that the cylinder means moves the blowing means into its retracting position, the sensor transfers a signal to the controller of the hot foil stamping device to allow the up and down movement of the lifting means.

Furthermore, the supporting means 22 also supports at least one advance shaft 21 for feeding a hot-stamping material, such as a metal foil, to a stamping area in the hot stamping device, so as to realize position transition of the advance shaft. The supporting means 22, the lifting means and the advance shaft 21 can work as advance shaft transition apparatus. FIGS. 3 and 4 show three advance shafts 21, but more or fewer advance shafts 21 may also be arranged according to actual demands. These advance shafts 21 are arranged basically in parallel with each other along a horizontal direction, and can rotate to propel the foil material for hot stamping towards the stamping area in the platen station 200.

Next, the lifting means in the preferable embodiment will be explained with reference to FIGS. 3 and 4. The lifting means includes a driving means 23 and a transmission means. The driving means is configured to produce a driving force, and the transmission means is configured to transmit the driving force to the supporting means 22. Specifically, the transmission means is connected between the driving means 3 and the advance shaft supporting frame 22. The driving means drives the transmission means to enable the supporting means 22 together with the advance shaft thereon to move between a first position and a second position. In the first position, the advance shaft 21 is located in an operation position, that is, when the supporting means 22 moves into the first position, the hot stamping and die cutting device is in the hot stamping mode, wherein the advance shafts 21 are operably rotated to feed the hot-stamping material, such as a metallic foil, towards the stamping area. When the supporting means 22 moves into the second position, the supporting means 22 also brings the advance shaft 21 into a non-operation position to give access to an operation area.

According to a preferred embodiment of the present invention, the driving means 23 in the lifting means adopts a motor. The motor is preferably and fixedly mounted on the top device frame of the hot stamping device, and mounted outside of the end portion of the advance shaft 21. The end portion of a driving shaft of the motor may be directly mounted to a transmission rod 25. Alternatively, as shown in FIG. 4, the end portion of the driving shaft of the motor is connected to the end portion of the transmission rod 25 by a transmission chain 29. In order to the rotary motion of the motor to be transferred to the transmission rod 25 at a proper transmission ratio, the transmission chain 29 can surround a driving wheel positioned at the end of the driving shaft of the motor and a driven wheel positioned at the end portion of the transmission rod 25, and two wheels are arranged at a proper transmission ratio.

It shall be noted that the driving means for producing a driving force is not limited to the motor, it may be configured by other actuating means, for example, the driving means comprise one or more of a motor, a belt, a chain, a cable, hydraulics and pneumatics.

In the present embodiment and as shown in FIGS. 3 and 4, the transmission means includes a transmission rod 25, two sets of lifting members 24 symmetrically arranged at both ends of the transmission rod 25 and a plurality of pulleys 26. The pulleys 26 can also be mounted on the top device frame 16. The lifting members 24 are preferably configured as lifting belts 24, one ends of two sets of lifting belts 24 surround the ends of the transmission rod 25 and are engaged with the ends of the transmission rod 25, then the lifting belts bypass the pulleys 26, and the other ends of the lifting belts 26 are fixedly connected to the advance shaft supporting frame 22. Thus, when the motor 23 rotates the transmission rod 25 in a first direction, the lifting belts 24 around the end of the transmission rod 25 and the pulleys 26 can lift up the shaft supporting means 22, and correspondingly lift up the advance shafts 21. If the transmission rod 25 is rotated in a second reverse direction, and the lifting belts 24 can enable the shaft supporting means 22 to be descended, and accordingly descend the advance shafts 21.

In the embodiment, the rotary motion of the driving means in the transmission mean is subjected to transition into the perpendicular motion perpendicular to the direction of the horizontal plane so as to perpendicularly lift both the advance shafts 21 and the blowing means 30 from the first position to the second position, and such a moving path is convenient.

The lifting means of the present invention is further particularly provided with accommodating mechanisms for accommodating the ends of the lifting belts 26. According to a preferred embodiment in FIG. 4, in the embodiment, the accommodating mechanism is configured into a form of an accommodating guide 27, and a guide slot is formed in the accommodating guide 27.

Preferably, the accommodating guides 27 are symmetrically arranged at both ends of the transmission rod 25, and are used for synchronously accommodating the ends of the lifting belts 24 at both sides. The guide slots in the accommodating guides 27 can accommodate the end portions of the lifting belts 24 extending out of the ends of the transmission rod 25 when the advance shaft 21 is lifted up. The accommodating rods 27 are preferably arranged at the ends of the transmission rod 25 and are perpendicular to a plane of the axis of the transmission rod 25. A length of the accommodating guide 27 corresponds to a distance between the first position and the second position.

In the embodiment, the accommodating guide 27 is arranged separately, but the accommodating guide 27 may also be integrated into the top device frame to become a portion of the top device frame.

The transmission means for transmitting the driving force from the driving means to the shaft supporting means can be configured as other form, such as the transmission means may comprises a belt, chain, gear, pulley and/or rod.

Moreover, the lifting means may be also provided with a limiting switch for limiting a lifting and descending position of the supporting means 22, and when the lifting means is lifted up or descended to a preset position, the limiting switch is actuated, so that the lifting means stops moving.

The hot foil stamping and die-cutting device 10 is provided with the top device frame and a lower base on the foil-feeding and stripping station 300 of the hot foil stamping and die-cutting device 10, the lifting means for lifting the blowing means 30 and the advance shaft is generally fixed on the top frame of the device, and the advance shaft and the blowing means 30 are movably arranged in a space between the top frame and the lower base. Assuming that the hot foil stamping and die-cutting device 10 is initially arranged in the hot foil stamping operation mode, then, the advance shaft is moved to the first position close to the lower base by the lifting means, and, the stamping material, such as the foil film, bypasses the advance shaft 21 to be fed to the station 200, meanwhile, the blowing means 30 is displaced into the projection position as shown in FIG. 4 by the displacement means for foil-separating operation; when the operator inputs an instruction, the mode is transmitted from the die-cutting working mode to the hot foil stamping working mode, at this time, the blowing means 30 is displaced into the retracting position shown in FIG. 3, and the driving means 23 rotates to lift the blowing means 30 and the advance shafts 21 until they reach the second position closed to the top frame, and the advance shaft 21 and the blowing means 30 are the non-operation position, then an operator mounts a stripping apparatus which needs to be used in the die-cutting operation in the lower base of the device 10, and thus, the device 10 is subjected to transition into a die-cutting operation mode.

By lifting and descending the blowing means by the lifting means in the present invention, convenience in transition of the hot foil stamping and die-cutting device 10 between the hot foil stamping and die-cutting modes is obviously improved.

In the present invention, the position of the blowing means and the advance shaft are transferred by the same set of the supporting means and the lifting means, the manufacturing cost of the device is saved, and the space in the device is fully utilized, and it can be easily combined into existing sheet equipment.

Although the present invention is disclosed as above with preferred embodiments, the present invention is not limited thereto and a person skilled in the art may make possible variations and modifications without departing from the spirit and scope of the present invention. Thus, any modifications, equivalent changes and variations made to the above embodiments according to the technical essence of the present invention without departing from the disclosure of the technical solution of the present invention all fall into the protection scope defined by the claims of the present invention.

The invention claimed is:

1. A hot foil stamping device having a hot foil stamping working mode and a die-cutting working mode, the hot foil stamping device comprising:

a blowing means unit, the blowing means unit including:

a blowing means having a blowing part and a supporting part, the blowing part being configured to inject a gas stream to a location of foil material to separate foil, the supporting part supporting the blowing part;

supporting means supporting the blowing means; and lifting means connected to the supporting means for moving the blowing means between a first position and a second position, wherein in the first position, the blowing part of the blowing means is at a working level, in the second position, the blowing part of the blowing means is at a non-working level to give access to an operation area, when the hot foil stamping device is in the hot foil stamping working mode, the blowing means is disposed in the first position, when the hot foil stamping device is in the die-cutting working mode, the blowing means is disposed in the second position, the supporting means further supports at least one advance shaft for feeding foils to a stamping area, in the first position, the at least one advance shaft is in an operation position, and in the second position, the at least one advance shaft is in a non-operation position.

2. The hot foil stamping device according to claim 1, wherein the blowing means unit further comprises displacement means provided between the blowing means and the supporting means for displacing the blowing means with respect to the supporting means between a projection position and a retracting position.

3. The hot foil stamping device according to claim 2, wherein the lifting means is configured to lift and lower the blowing means when the blowing means is disposed in the retracting position.

4. The hot foil stamping device according to claim 2, wherein the displacement means includes a first slider and a second slider that are slidely mated with each other, a first one of the first slider and the second slider is provided to the supporting means, and a second one of the first slider and the second slider is provided to the supporting part of the blowing means.

5. The hot foil stamping device according to claim 2, wherein the displacement means further includes a displacement actuator, the displacement actuator includes one of pneumatic means, hydraulic means, or a motor.

6. The hot foil stamping device according to claim 1, wherein the lifting means includes driving means and/or transmission means.

7. The hot foil stamping device according to claim 6, wherein the driving means includes one or more of a motor, a belt, a chain, a cable, hydraulics, or pneumatics.

8. The hot foil stamping device according to claim 6, wherein the transmission means comprises a belt, chain, gear, pulley and/or rod.

9. The hot foil stamping device according to claim 1, further comprising:

a feeding station, the feeding station being used for feeding sheets to a hot foil stamping die-cutting device;

a platen station, the platen station being positioned on a downstream of the feeding station along a sheet conveying direction and used for carrying out pressing-cutting or embossing machining on the sheets;

a foil-feeding and stripping station, the foil-feeding and stripping station being positioned on the downstream of the platen station along a sheet conveying path; and a delivery station, the delivery station being positioned on the downstream of the foil-feeding and stripping station and used for enabling the machined sheets to form a sheet stack, wherein the blowing means unit is arranged in the foil-feeding and stripping station, and when the hot foil stamping device is in the die-cutting working mode, the blowing means is moved to the second position.

* * * * *